United States Patent [19]

Beppu et al.

[11] Patent Number: 4,551,240

[45] Date of Patent: Nov. 5, 1985

[54] APPARATUS FOR CLASSIFYING PARTICULATE MATERIAL WITH AIR CURRENTS

[75] Inventors: Masaru Beppu; Setsuo Agawa; Takeshi Hazeyama; Toshiyuki Nashimoto, all of Tokyo, Japan

[73] Assignee: Nittetsu Mining Co., Ltd., Japan

[21] Appl. No.: 575,173

[22] Filed: Jan. 30, 1984

[30] Foreign Application Priority Data

Feb. 8, 1983 [JP] Japan ..... 58-18133

[51] Int. Cl.[4] ..... B07B 7/086

[52] U.S. Cl. ..... 209/143; 209/149; 209/3

[58] Field of Search ..... 209/143, 144, 146, 147, 209/149, 139, 138, 211, 210, 3; 55/461, 455, 266, 261, 431; 141/285, 286

[56] References Cited

U.S. PATENT DOCUMENTS

| | | | |
|---|---|---|---|
| 1,616,566 | 2/1927 | Barker | 209/143 |
| 2,681,476 | 6/1954 | Van Doorn | 209/143 |
| 4,153,541 | 5/1979 | Rumpt et al. | 209/143 |

FOREIGN PATENT DOCUMENTS

| | | | |
|---|---|---|---|
| 636327 | 3/1962 | Italy | 209/210 |
| 2024038 | 1/1980 | United Kingdom | 55/461 |

*Primary Examiner*—Frank W. Lutter

*Assistant Examiner*—Wm. Bond

*Attorney, Agent, or Firm*—McGlew and Tuttle

[57] ABSTRACT

An apparatus for classifying particulate material with air currents wherein the particulate material containing various kinds of particles of different sizes is conveyed with air currents and the particles are given with forces of inertia differing from one another depending on particle size, including a supply port for supplying the particulate material to be classified, an air current inlet port for introducing into the apparatus an air current of high flow velocity located in the vicinity of the particulate material supply port, air current inlet ports for introducing into the apparatus other air current of lower flow velocity than the air current of high flow velocity, a main passage formed in the apparatus communicated with the particulate material supply port and the air current inlet ports, and a subsidiary passage branching from the main passage located at the side of the apparatus at which one of the air currents of low flow velocity flows. This flow of air current of low flow velocity constitutes a flow adjusting air current layer interposed between walls defining the main and subsidiary passages and the particulate material conveyed by the air currents for preventing the flow of the particulate material from being disturbed by a vortical air flow occurring along the walls defining the main and subsidiary passages.

3 Claims, 4 Drawing Figures

APPARATUS FOR CLASSIFYING PARTICULATE MATERIAL WITH AIR CURRENTS

FIELD OF THE INVENTION

This invention relates to an apparatus for classifying particulate material with air currents wherein a stream of particulate material composed of various kinds of particulate material distinct in size from one another are blown with air currents and each given with a force of inertia commensurate with the particle size, so that the particulate material can be classified in accordance with the difference in the force of inertia given thereto.

DESCRIPTION OF THE PRIOR ART

Generally, classification of particulate material with air currents is relied on when an attempt is made to classify by a dry system such particulate material of small particle size as does not lend itself to the operation of sifting coarse particles from fine particles on an industrial scale. When it is desired to classify particulate material of different particle sizes more precisely than is possible by using gravity classification whereby the particulate material is classified merely on the basis of difference in gravitational pull exerted on particulate material of different weights flowing in an air current, the aforesaid type of apparatus for classifying particulate material with air currents is used wherein classification is achieved by taking advantage of the difference in the force of inertia given to the particulate material of different sizes and weight.

Figure 1:
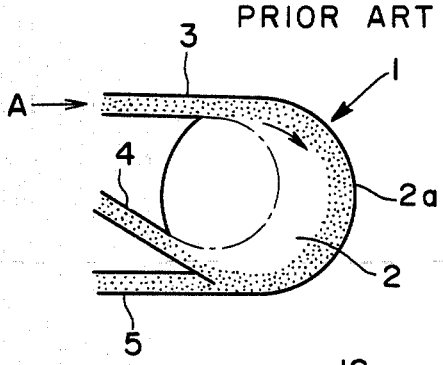
FIG. 1 PRIOR ART
FIG. 1 is a sectional side view of the essential portion of an apparatus of the prior art for classifying particulate material with air currents.

One example of the prior art apparatus of the type described is shown in FIG. 1, in which the classifying apparatus generally designated by the reference numeral 1 comprises a main body 2 of a cylindrical shape extending perpendicular to the plane of the figure, a particulate material supply pipe 3 and discharge pipes 4 and 5. As seen in FIG. 1, the supply pipe 3 is connected to the main body 2 at its upper side and extends tangentially thereof, and the discharge pipes 4 and 5 are connected to the main body 2 at its lower side and located in upper and lower positions respectively.

A stream of particulate material of various kinds is supplied with an air current A through the supply pipe 3 into the main body 2. The stream of particulate material comprises particles of various particle sizes which are given with forces of inertia commensurate with their particle sizes by the air current A. More specifically, particulate material of large grain size (hereinafter coarse particles) is given with a force of inertia of high magnitude, and particulate material of small grain size (hereinafter minuscule particles) is given with a force of inertia of low magnitude. When the stream of particulate material of different grain sizes flows in the air current A through the main body 2, the coarse particles in the stream having a high force of inertia would be located in a position close to a wall 2*a* of the main body and the minuscule particles in the stream having a low force of inertia would be located in a position remote from the wall 2*a*. Thus, when the stream is released from the main body 2, the minuscule particles would be released through the upper discharge pipe 4 and the coarse particles would be released through the lower discharge pipe 5, so that the particulate material would be classified into two groups.

The following disadvantages will be associated with the classification apparatus 1 shown in FIG. 1. The stream of particulate material supplied through the particulate material supply pipe 3 would be spread to a wide zone which would extend through the entire cross-sectional surface (disposed perpendicular to the plane of FIG. 1). As a result, the particulate material of various kinds in the stream would be insufficiently scattered therein, and the paths of flow of various particles in the stream would be unstable. In addition, the air current would become turbulent in flow as it is spaced apart from the wall 2*a* toward the center of the main body 2, so that the coarse and minuscule particles flowing in a central portion of the air current would be mixed with each other as they flow in a current of turbulent flow.

Because of these disadvantages, it would be impossible for the classification apparatus shown and described hereinabove to classify with a high degree of precision the minuscule particles smaller than 100 $\mu$m in size. Thus, proposals have been made to use various measures to cope with this situation. For example, Japanese Patent Publication Sho-55-6433 (DEP 2538190.2) discloses an apparatus in which the particulate material supply pipe 3 has a narrow port at its end serving as a supply nozzle for increasing the degree of dispersion of the particulate material in the stream and at the same time stabilize the paths of flow of various particles in the stream. Another proposal discloses an apparatus wherein a stream of particulate material is injected into the apparatus after being mixed with air under high pressure. However, no proposals that have hitherto been made have succeeded in providing an apparatus whereby a sufficiently high degree of dispersion to enable the minuscule particles to be classified with a satisfactorily high degree of precision can be obtained. Particularly, in the apparatus using air under high pressure for injecting a stream of particulate material, pressure cut-off means and other additional equipment is required, making the apparatus large in size and high in cost.

A further proposal deals with an apparatus wherein a portion of the wall 2*a* of the main body 2 which extends between the supply pipe 2 and the upper discharge pipe 4 is curved toward the opposite portion of the wall 2*a* as indicated by a phantom line in FIG. 1 to avoid the production of a turbulent flow in the apparatus 1, as disclosed in Japanese Patent Publication Sho-55-6433 referred to hereinabove. However, the results of the experiments conducted by us show that it is not before the curved shape of the wall, the flow velocity of the air current and the nature of the particulate material have satisfied very narrow ranges of conditions that the air current can be regulated as desired in the type of apparatus of the aforesaid proposal. Thus, the shape of the wall would have to be varied if the flow velocity of the air current should show a change, even if it is very small, to achieve the desired degree of precision in classifying the minuscule particles in the stream of particulate material flowing through such apparatus.

SUMMARY OF THE INVENTION

This invention has been developed for the purpose of obviating the aforesaid disadvantages of the prior art. Accordingly, the invention has as its object the provision of an apparatus for classifying particulate material with air currents capable of obtaining a sufficiently high degree of dispersion of the particulate material flowing in an air current and stabilizing the paths of flow of particles sufficiently to enable classification of the particulate material to be achieved satisfactorily while avoiding disturbance which might otherwise be caused to occur in the flow of the particulate material by turbulent flow without requiring any additional equipment which increases cost.

The aforesaid object is accomplished according to the invention by an apparatus for classifying particulate material with air currents comprising a primary air current inlet port for introducing into the apparatus a primary air current for conveying the particulate material to be classified, a secondary air current inlet port for introducing into the apparatus a secondary air current separate from the primary air current, a tertiary air current inlet port interposed between the primary and secondary air current inlet ports for introducing into the apparatus a tertiary air current of a higher flow velocity than the primary and secondary air currents, at least one particulate material supply port located in the vicinity of the tertiary air current inlet port for supplying to the apparatus the particulate material to be classified, a main passage communicated with the primary air current inlet port, secondary air current inlet port, tertiary air current inlet port and particulate material supply port to lead to a particulate material discharge port the particulate material introduced into the apparatus through the particulate material supply port and conveyed by the air currents introduced into the apparatus through these ports, and at least one subsidiary passage branching from the main passage at a portion of a wall defining the main passage which is located on the side of the secondary air current inlet port and formed with at least one other particulate material discharge port at a lower end thereof, wherein a force of inertia is given to the particulate material supplied through the particulate material supply port and conveyed by the tertiary air current while being gathered together in a narrow region, and a flow adjusting air current layer is formed by the secondary air current in a position between the wall defining the main passage and a wall defining the subsidiary passage and a flow of the particulate material through these passages.

The secondary air current containing no particulate material flows along the walls defining the main passage and the subsidiary passage branching from the main passage constitutes the flow adjusting air current layer free from turbulence which flows between a vortical air flow produced at the junction between the main passage and the subsidiary passage and the particulate material conveyed by the air current of high flow velocity, so that the flow of the particulate material is free from turbulent flow. The provision of the particulate material supply port in the vicinity of the tertiary air current inlet port to allow the tertiary air current of high flow velocity to flow in the vicinity of the particulate material supplied to the apparatus enables the particulate material to be fed forwardly after being gathered together in a narrow region by the venturi effect. As a result, the particulater material can be dispersed sufficiently to enable classification of the particles to be effected with a high degree of precision and allows the particles to flow stably through respective paths. To accomplish the object of classifying the particles with a high degree of precision, the apparatus according to the invention requires no special equipment, except for the bloawer and air compressor which are usually required for performing classification operations, such as a high pressure tank, so that the apparatus is free from an increase in size and cost.

DESCRIPTION OF THE PREFERRED EMBODIMENTS

A preferred embodiment will now be described by referring to FIG. 2, in which a conduit 6 extending downwardly and then curving leftwardly in the plane of the figure defines a main passage 11 therein which is divided by a partition plate 7 into the main passage 11 and a subsidiary passage 12. The conduit 6 is formed at an upper end portion *6a* with a primary air current inlet port 13, a particulate material supply port 14, a tertiary air current inlet port 15 and a secondary air current inlet port 16 located in the indicated order from the left side toward the right side, and the main passage 11 terminates at a first particulate material discharge port 8 formed at a lower end of the conduit 6 while the subsidiary passage 12 terminates at a second particulate material discharge port 12 also formed at the lower end of the conduit 6. Thus, the subsidiary passage 12 constitutes a passage branching from the main passage 11.

Although not shown, an exhaust blower 20, 21 may be mounted in the vicinity of the first and second particulate material discharge ports 8 and 9 for drawing a primary air current A and a secondary air current B through the primary air current inlet port 13 and the secondary air current inlet port 16 respectively. However, this is not essential, and the primary and secondary air currents A and B can be made to flow through the primary and secondary air current inlet ports 13 and 16 into the main passage 11 mere by using an air blower. The tertiary air current inlet port 15 is connected to an air compressor 22, not shown, which supplies compressed air to the tertiary air current inlet port 15 to cause a high velocity air current C to flow through the tertiary air current inlet port 15 into the main passage 11.

Figure 3:
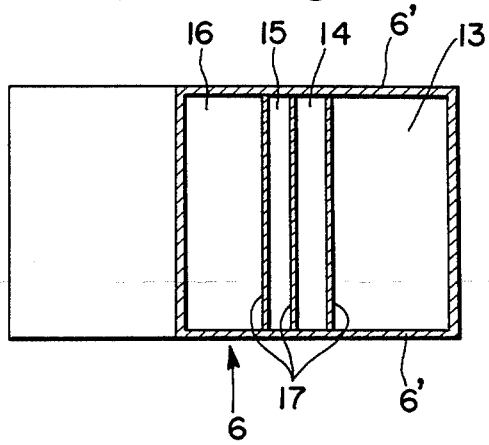
FIG. 3 is a plan view as seen in the direction of arrows III—III in FIG. 2.

The air current inlet ports 13, 15 and 16 and the particulate material supply port 14 are separated from one another by a partition plates 17 located between walls 6' of the conduit 6, as shown in FIG. 3.

The particulate material supply port 14 is connected to a particulate material supply device 19 in which a particulate material 18 is stored to be fed therefrom into the main passage 11 through the particulate material supply port 14.

Figure 2:
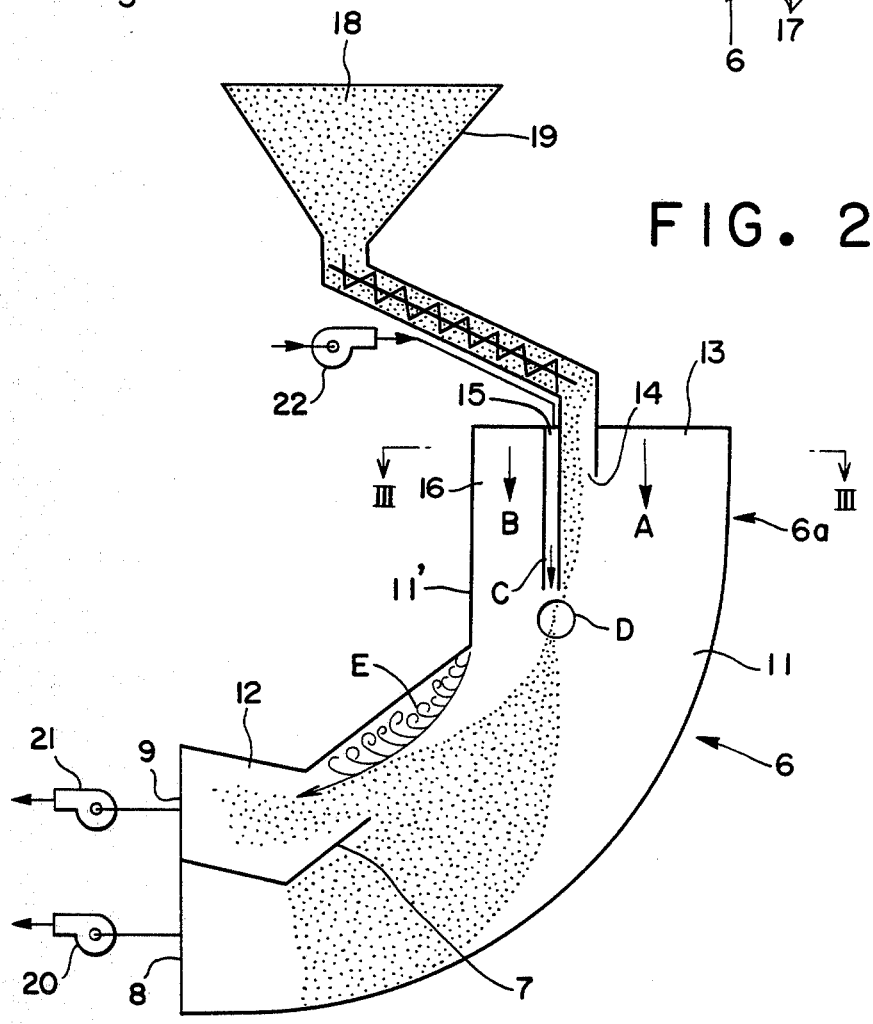
FIG. 2 is a sectional side view of the apparatus for classifying particulate material with air currents comprising one embodiment of the invention.

The embodiment of the apparatus for classifying particulate material with air currents in conformity with the invention which is shown in FIGS. 2 and 3 is constructed as aforesaid. Its operation is as follows. The particulate material 18 supplied by the particulate material supply device 19 into the main passage 11 of the conduit 6 through the particulate material supply port 14 is first gathered together in a narrow zone D by the venturi effect of the high velocity air current C introduced into the main passage 11 through the tertiary air current inlet port 15. By supplying the particulate material in a stream which is confined to a small region, it is possible to eliminate the instability of the paths of flow of the particles which would occur when the particulate material is supplied in a stream dispersed in a wide region.

The minuscule particles of the particulate material gathered together in the narrow region D are given with a force of inertia by the high velocity air current C introduced into the main passage 11 through the tertiary air current inlet port 15. Even if the minuscule particles were congregated into large masses, the masses could be dispersed into individual minuscule particles by the force exerted thereon by the high velocity air current C. The force of inertia given to each of the minuscule particles dispersed by the force of the high velocity air current C may vary depending on the size of the minuscule particle. A coarse particle will have a high force of inertia, while a fine particle will have a low force of inertia. The particles each having a different force in inertia given thereto flow in a direction in which the force if inertia is oriented (downwardly in the plane of the figure) and are at the same time conveyed toward the particulate material discharge ports 8 and 9 by a force produced by a combination of the primary air current A, secondary air current B and high velocity air current C. When the particles are conveyed in this way, the coarse particles having a higher force of inertia than the fine particles flow at a lower level than the fine particles, so that the coarse particles are discharged through the first particulate material discharge port 8 communicated with the main passage 11 and the fine particles are discharged through the second particulate material discharge port 9 communicated with the subsidiary passage 12.

Figure 4:
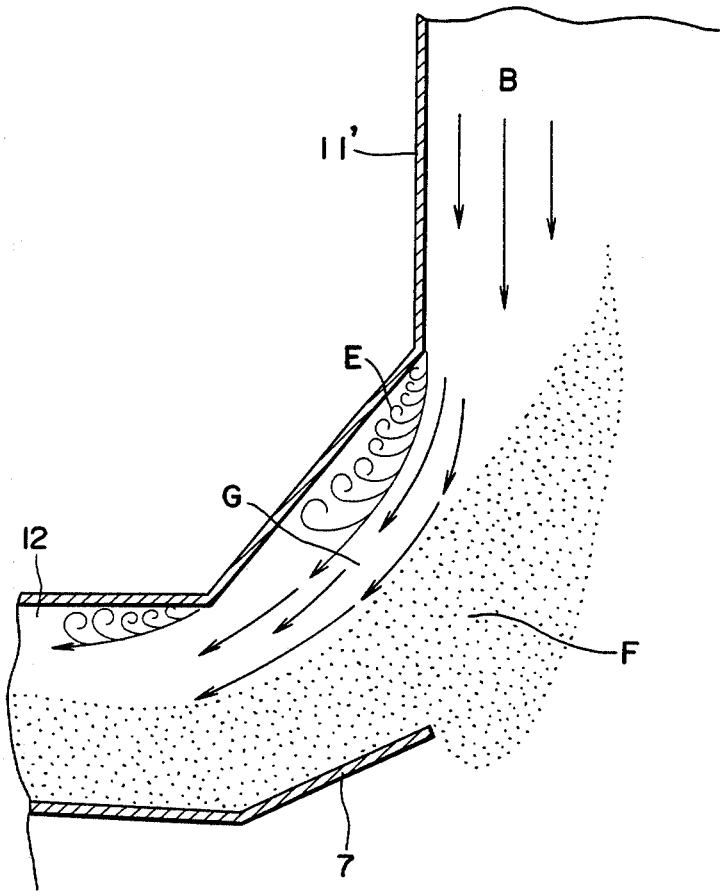
FIG. 4 is a view, on an enlarged scale, of the position in which the subsidiary passage branches from the main passage shown in FIG. 2.

Thus, the particulate material supplied through the particulate material supply port 14 into the main passage 11 is classified into the coarse particles and fine particles which are discharged through the first and second particulate material discharge ports 8 and 9 from the main and subsidiary passages 11 and 12 respectively. When classification of the particulate material is performed as aforesaid, a vortical air flow E is produced in a portion of the conduit 6 in which the subsidiary passage 12 branches from the main passage 11, as shown in FIG. 4. As shown, the vortical air flow E is produced along the inner wall surface of the conduit 6 and the particulate material would be engulfed in the vortical air flow, making it impossible to effect classification thereof with a high degree of precision unless means is provided for avoiding this phenomenon. To cope with this situation, the secondary air current B is made to flow along an inner wall surface 11 of the conduit 6 at which the subsidiary passage 12 branches from the main passage 11 (see FIG. 2) and between the vortical air flow E and a flow of particulate material F, to thereby constitute a flow adjusting current layer G which is a current layer free from turbulence. The presence of the flow adjusting air current layer G is conducive to prevention of the particulate material from being engulfed in the vortical air flow, thereby enabling classification of the particulate material to be performed with a high degree of precision. As described hereinabove, the main passage 11 is partitioned from the subsidiary passage 12 by the partition plate 7. The shape of the partition plate 7 and the angle at which it is disposed with respect to the stream of the particulate material exert influences on the degree of precision with which classification of the particulate material is effected. Thus, one only has to suitably select the shape of the partition plate 7 and the angle at which it is disposed depending on the nature of the particulate material to be classified or on the basis of the particle size on the border line for separating coarse particles from fine particles.

In the embodiment shown and described hereinabove, the main passage 11 is curved in the conduit 6. The invention is not limited to this specific shape of the main passage 11, and the main passage 11 may be straight without departirg from the scope of the invention.

In the invention, the particulate materiai stream is kept undisturbed by the vortical air flow E by forming the flow adjusting air current layer G between the inner wall surface of the conduit 6 defining the subsidiary passage 12 and the flow of particulate material F. Thus, the need to specifically limit the shape of the wall surface of the conduit 6 constituting the subsidiary passage 12 is eliminated. The wall surface may be straight as shown, or it may be either irregular or curving, as desired.

Only one partition plate 7 is shown and described as being used. However, this is not restrictive and a plurality of partition plates may be used. When this is the case, a plurality of subsidiary passages will be formed. By branching a plurality of subsidiary passages from the main passage, classification of the particulate material can be effected in a manner to separate the particles into a larger number of groups.

The particulate material inlet port 14 has been shown and described as being interposed between the primary air current inlet port 13 and the tertiary air current inlet port 15. However, the invention is not limited to this arrangement of the particulate material supply port, and the particulate material supply port 14 may be interposed between the tertiary air current inlet port 15 and secondary air current inlet port 16

Experiments have been conducted by using the embodiment of the apparatus for classifying particulate material with air currents shown and described hereinabove. The results of the experiments obtained are shown in a table hereinafter.

| | Grain Size Distribution (weight %) | | |
|---|---|---|---|
| | A | B | Particulate Material |
| Particle Size (μm) | | | |
| 14.92 | 100 | | 100 |
| 10.55 | 98.4 | | 93.3 |
| 7.46 | 97.0 | | 81.7 |
| 5.27 | 89.3 | | 65.2 |
| 3.73 | 79.4 | 100 | 47.1 |
| 2.63 | 62.1 | 95.2 | 36.6 |
| 1.69 | 46.3 | 82.5 | 24.4 |
| 1.01 | 25.9 | 57.3 | 13.7 |
| 0.66 | 11.5 | 30.7 | 6.0 |
| 0.43 | 2.2 | 9.8 | 1.0 |
| 0.34 | 0 | 2.8 | 0 |
| 0.27 | | 1.7 | |
| 0.17 | | 0.6 | |
| Specific Surface Area $cm^2/g$ | 20210 | 30830 | 13140 |

In the table shown hereinabove, the rightmost column shows the grain size distribution of the particulate material containing calcium carbonate as its principal component. The column B shows the grain size distribution of the minuscule particles recovered through the second particulate material discharge port 9 shown in FIG. 9. The column A shows the grain size distribution of the particles recovered through the second particulate material discharge port when no secondary air current B in FIG. 2 was not used. In obtaining the grain size distributions shown in columns A and B, the high velocity air current C had a flow velocity of 150 m/s, and all the air currents A, B and C had a mean flow velocity of 60 m/s.

What is claimed is:

1. An apparatus for classifying particulate material using air currents, comprising:

a curved conduit having an upper portion and a lower portion, and having an inner side wall and an outer side wall, said upper portion defining a main passage;

particulate material supply means having a particulate material supply port opening into said main passage of said upper portion for supplying particulate material into said upper portion;

a partition plate disposed in said lower portion of said conduit between said inner and outer side walls for dividing an interior of said lower portion into an outside first discharge port defined between said outer side wall and said partition plate and an inside second discharge port defined between said inner side wall and said partition plate;

said conduit including a primary air inlet in said upper portion thereof between said outer side wall and said material supply port, said conduit including a secondary air inlet port in said upper portion between said inner side wall and said material supply port;

air blower means in communication with said conduit for establishing a primary air current from said primary inlet port to said lower portion of said conduit and a secondary air current from said secondary air inlet port to said lower portion of said conduit;

means defining a tertiary air current inlet port in said upper portion of said conduit between said secondary air inlet port and said material supply port; and high velocity air current means in communication with said tertiary air current inlet port for supplying high velocity air through said tertiary air current inlet port and into said main passage directly adjacent said material supply port whereby said particulate material from said material supply port is drawn into a narrow zone immediately upsteam of the tertiary air current inlet port by a venturi effect within said main passage of said upper portion.

2. An apparatus according to claim 1, wherein said tertiary air current inlet port and said material supply port are defined between three spaced apart partitions extending vertically in said main passage of said upper portion.

3. An apparatus according to claim 2, wherein said inner side wall comprises a plurality of connected together flat wall sections and said outer side wall is curved.

* * * * *